US010665963B2

(12) United States Patent
Huang

(10) Patent No.: US 10,665,963 B2
(45) Date of Patent: May 26, 2020

(54) ELECTRICAL CONNECTOR INCLUDING AN INSULATION BODY AND CONTACTS

(71) Applicant: Tyco Electronics (Shanghai) Co. Ltd., Shanghai (CN)

(72) Inventor: Liang Huang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/233,244

(22) Filed: Dec. 27, 2018

(65) Prior Publication Data

US 2019/0207326 A1 Jul. 4, 2019

(30) Foreign Application Priority Data

Dec. 28, 2017 (CN) ..... 2017 1 1464716

(51) Int. Cl.

| | |
|---|---|
| ***H01R 4/02*** | (2006.01) |
| ***H01R 13/50*** | (2006.01) |
| ***H01R 12/70*** | (2011.01) |
| ***H01R 13/6461*** | (2011.01) |
| *H01R 13/502* | (2006.01) |
| *H01R 107/00* | (2006.01) |
| *H01R 12/72* | (2011.01) |
| *H01R 24/60* | (2011.01) |
| *H01R 12/57* | (2011.01) |

(52) U.S. Cl.

CPC ..... *H01R 4/02* (2013.01); *H01R 12/70* (2013.01); *H01R 13/50* (2013.01); *H01R 13/6461* (2013.01); *H01R 12/57* (2013.01); *H01R 12/724* (2013.01); *H01R 13/502* (2013.01); *H01R 24/60* (2013.01); *H01R 2107/00* (2013.01)

(58) Field of Classification Search

CPC ..... H01R 4/02; H01R 12/70; H01R 13/50; H01R 13/602; H01R 2107/00; H01R 12/60; H01R 24/60; H01R 13/6461

USPC ..... 439/701, 540.1, 541.5, 874

See application file for complete search history.

(56) References Cited

U.S. PATENT DOCUMENTS

| | | | | |
|---|---|---|---|---|
| 5,336,109 A * | 8/1994 | Hillbish | H01R 12/724 | 439/541.5 |
| 5,340,320 A * | 8/1994 | Puerner | H01R 12/716 | 439/686 |
| 5,863,222 A * | 1/1999 | Kinsey, Jr. | H01R 13/658 | 439/607.53 |
| 6,200,161 B1 * | 3/2001 | McClinton | H01R 27/02 | 439/541.5 |
| 6,350,152 B1 * | 2/2002 | Belopolsky | H01R 13/7195 | 439/541.5 |
| 6,494,724 B1 * | 12/2002 | Bixler | H01R 13/506 | 439/79 |
| 2009/0149072 A1 * | 6/2009 | Xiang | H01R 12/712 | 439/638 |
| 2011/0034088 A1 * | 2/2011 | Mao | H01R 12/724 | 439/701 |

(Continued)

*Primary Examiner* — Harshad C Patel

(74) *Attorney, Agent, or Firm* — Barley Snyder

(57) ABSTRACT

A connector comprises an insulation body and a row of first contacts arranged on the insulation body at a first pitch. Each of the first contacts includes a first solder foot, a first fixation portion, and a first connection portion between the first solder foot and the first fixation portion. No insulation partition rib is disposed between the first connection portions of any two adjacent first contacts.

16 Claims, 3 Drawing Sheets

(56) References Cited

U.S. PATENT DOCUMENTS

2013/0316590 A1* 11/2013 Fan ..... H01R 13/514
439/656
2014/0220799 A1* 8/2014 Tai ..... H01R 13/6461
439/108

* cited by examiner

ELECTRICAL CONNECTOR INCLUDING AN INSULATION BODY AND CONTACTS

CROSS-REFERENCE TO RELATED APPLICATION

This application claims the benefit of the filing date under 35 U.S.C. § 119(a)-(d) of Chinese Patent Application No. 201711464716.7, filed on Dec. 28, 2017.

FIELD OF THE INVENTION

The present invention relates to a connector and, more particularly, to a connector including an insulation body and a row of contacts arranged on the insulation body.

BACKGROUND

An input/output connector (I/O connector) generally includes an insulation body and at least one row of contacts arranged in parallel on the insulation body. Each of the contacts has a fixation portion fixed to the insulation body, a solder foot at an end of the contact, a contact portion at an opposite end of the contact, a connection portion between the fixation portion and the solder foot, and an elastic arm between the fixation portion and the contact portion. The insulation body has a plurality of insulation partition ribs, and the connection portions of two adjacent contacts are separated by one of the insulation partition ribs.

The connection portions of the contacts are positioned so as to avoid a short circuit between the connection portions. However, because the insulation partition rib is disposed between the connection portions, the width of the contacts and the spacing between adjacent contacts is limited, which restricts the performance of the connector and is particularly disadvantageous for suppressing resonance of the connector.

SUMMARY

A connector comprises an insulation body and a row of first contacts arranged on the insulation body at a first pitch. Each of the first contacts includes a first solder foot, a first fixation portion, and a first connection portion between the first solder foot and the first fixation portion. No insulation partition rib is disposed between the first connection portions of any two adjacent first contacts.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
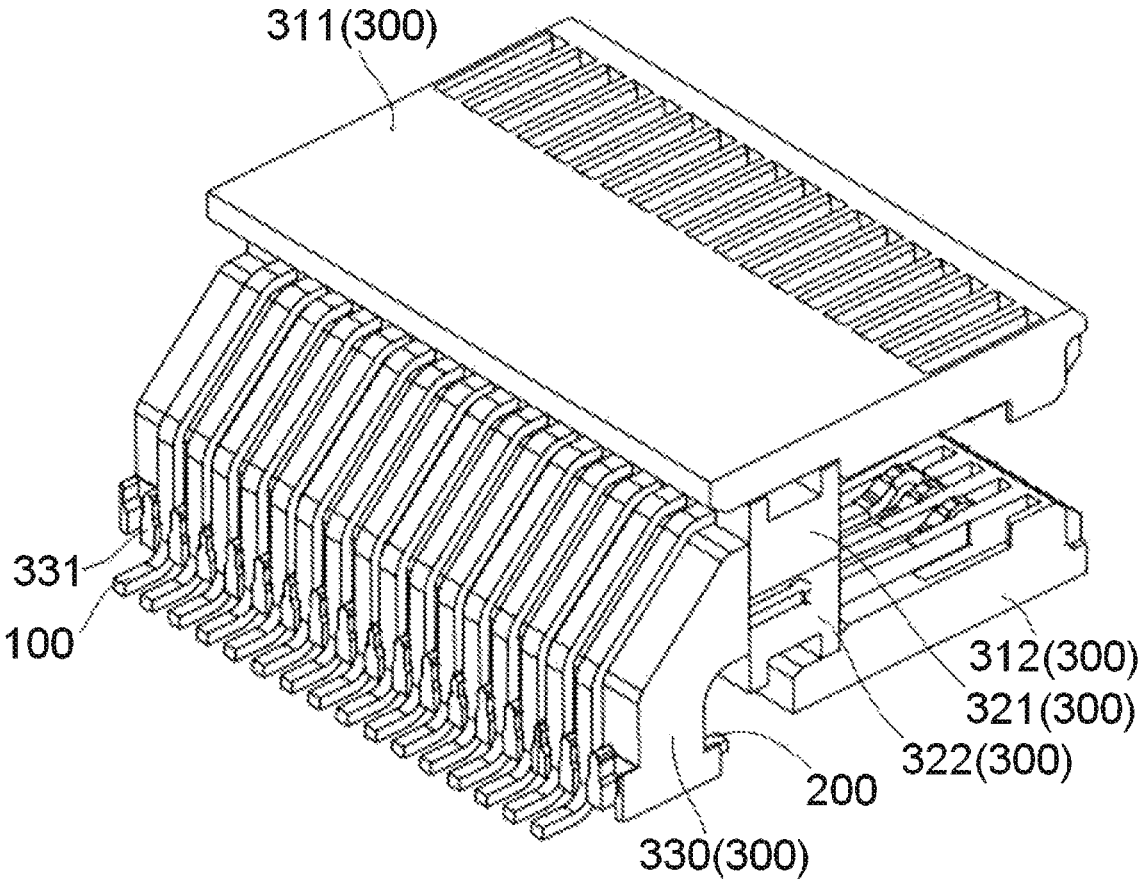
FIG. 1 is a perspective view of a connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
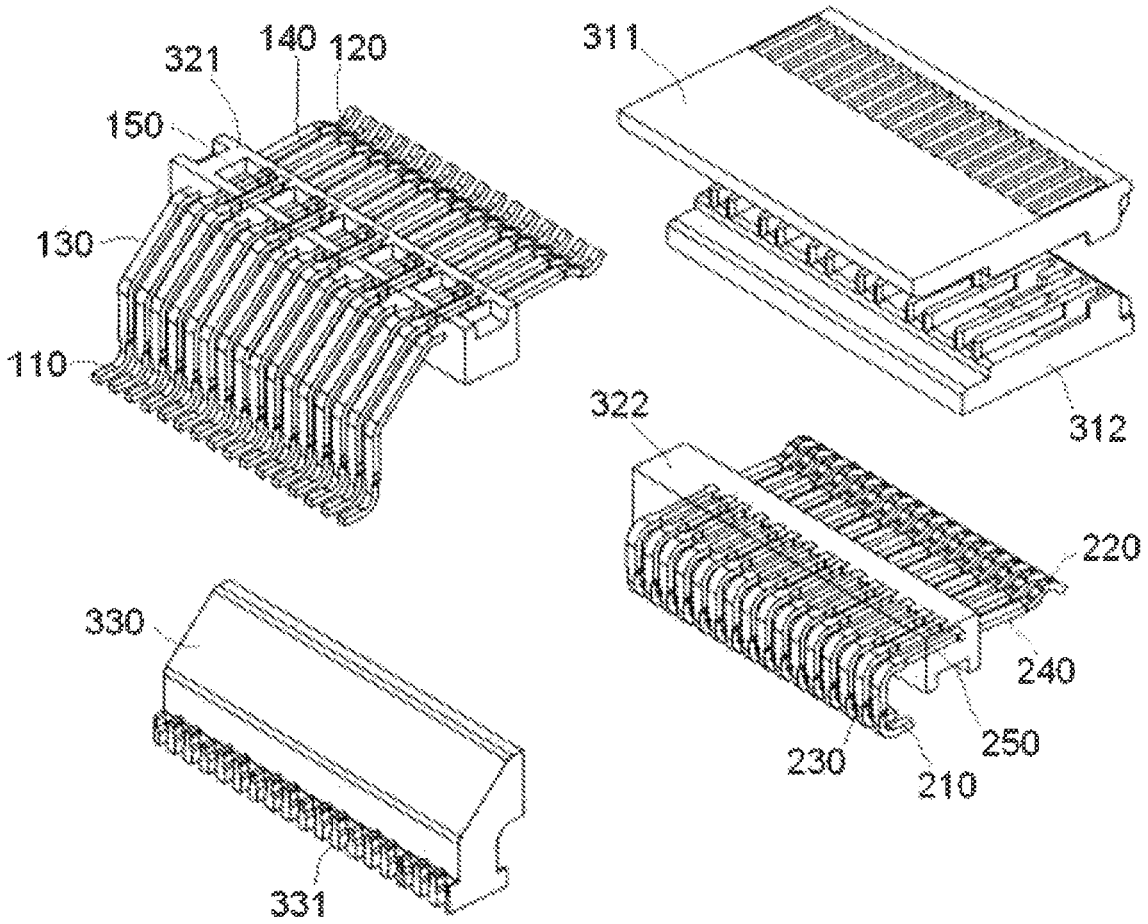
FIG. 2 is an exploded perspective view of the connector.

A connector according to an embodiment, as shown in FIGS. 1 and 2, includes an insulation body 300 and at least one row of contacts 100, 200. At least one row of contacts 100, 200 is arranged on the insulation body 300 at a first pitch. In the shown embodiment, the connector includes two rows of contacts 100, 200 with a row of first contacts 100 and a row of second contacts 200. In other embodiments, the connector may include one row of contacts or may include three or more rows of contacts.

As shown in FIGS. 1 and 2, the row of first contacts 100 are arranged on the insulation body 300 at a first pitch. Each of the first contacts 100 includes a first solder foot 110, a first fixation portion 150, and a first connection portion 130 between the first solder foot 110 and the first fixation portion 150. The first solder foot 110 is located at a first end of the first contact 100 and is adapted to be soldered to a circuit board. The first fixation portion 150 is fixed to the insulation body 300.

Figure 3:
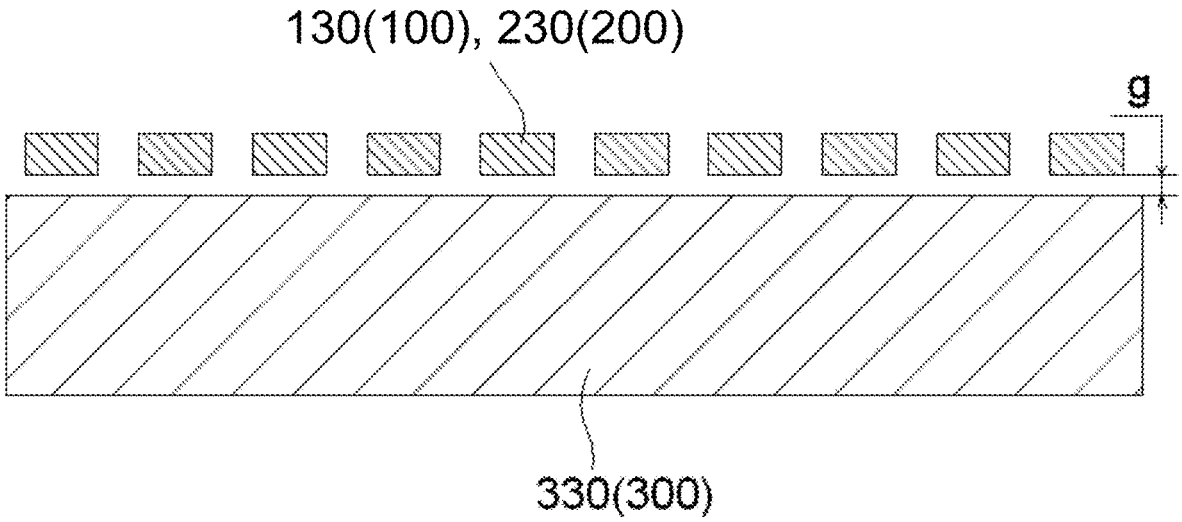
FIG. 3 is a sectional side view of the connector.

As shown in FIGS. 1-3, no insulation partition rib is disposed between any two adjacent first connection portions 130. That is, there is no insulation partition rib formed on the insulation body 300 for separating the adjacent first connection portions 130. Adjacent first connection portions 130 are spaced apart from each other by an air gap, so that a design space for the width and the pitch of the contacts 100 may be increased. By adjusting the width and the pitch of the contacts 100, the resonance of the connector may be effectively suppressed, improving the performance of the connector.

A first air gap g is disposed between a connection portion positioning body 330 of the insulation body 300 and each of the first connection portions 130, as shown in FIG. 3; the first connection portions 130 are not in contact with the insulation body 300. In various embodiments, a resonance amplitude of the connector is adjusted by adjusting the size of the first air gap g between the insulation body 300 and each of the first connection portions 130, thereby effectively suppressing or even eliminating the resonance of the connector and further improving the performance of the connector.

Figure 4:
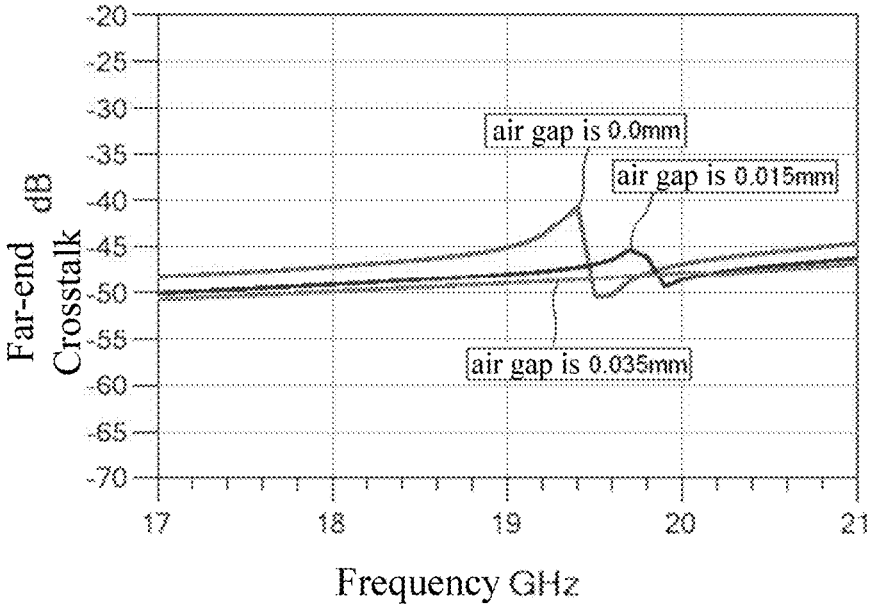
FIG. 4 is a graph of a relationship between a far-end crosstalk and an air gap between a connection portion of a contact of the connector and an insulation body of the connector.

A graph of a relationship between a far-end crosstalk and the first air gap g formed between the connection portion 130 of the contact 100 and the insulation body 300 is shown in FIG. 4. In an embodiment, the far-end crosstalk is formed between a signal contact and a ground contact of the connector. As shown in FIG. 4, when the first air gap g between the connection portion 130 of the contact 100 and the insulation body 300 is equal to about 0 mm, there is a large peak value (i.e., resonance) of the crosstalk. When the first air gap g is equal to about 0.015 mm, there is a medium peak value (i.e., resonance) of the crosstalk. When the first air gap g is equal to about 0.035 mm, there is a small peak value (i.e., resonance) of the crosstalk; the peak value is almost equal to zero. Therefore, in the embodiment shown in FIG. 4, for suppressing or even eliminating the resonance of the connector, the first air gap g may be adjusted to be equal to about 0.035 mm.

The row of second contacts 200, as shown in FIGS. 1 and 2, are positioned below the row of first contacts 100 and arranged on the insulation body 300 at a second pitch. In an embodiment, the second pitch is equal to the first pitch. Each of the second contacts 200 includes a second solder foot 210, a second fixation portion 250, and a second connection portion 230 between the second solder foot 210 and the second fixation portion 250. The second solder foot 210 is located at a first end of the second contact 200 and is adapted to be soldered to a circuit board. The second fixation portion 250 is fixed to the insulation body 300.

As shown in FIGS. 1 and 2, no insulation partition rib is disposed between any two adjacent second connection portions 230. That it, there is no insulation partition rib formed on the insulation body 300 for separating the adjacent second connection portions 230. Adjacent second connection portions 230 are spaced apart from each other by an air gap, so that a design space for the width and the pitch of the contacts 200 may be increased. By adjusting the width and the pitch of the contacts 200, the resonance of the connector may be effectively suppressed, improving the performance of the connector.

Similar to the first contacts 100, in the shown embodiment, there is a second air gap between the insulation body 300 and each of the second connection portions 230; the second connection portions 230 are not in contact with the insulation body 300. In various embodiments, the resonance amplitude of the connector may be adjusted by adjusting the size of the second air gap between the insulation body 300 and each of the second connection portions 230, thereby effectively suppressing or even eliminating the resonance of the connector and further improving the performance of the connector. In an embodiment, the second air gap between the insulation body 300 and each of the second connection portions 230 is equal to the first air gap g between the insulation body 300 and each of the first connection portions 130.

Each of the first contacts 100, as shown in FIG. 2, includes a first contact portion 120 and a first elastic arm 140 between the first contact portion 120 and the first fixation portion 150. The first contact portion 120 is adapted to be in resilient electrical contact with an inserted card. Similarly, each of the second contacts 200 includes a second contact portion 220 and a second elastic arm 240 between the second contact portion 220 and the second fixation portion 250. The second contact portion 220 is adapted to be in resilient electrical contact with an inserted card.

As shown in FIGS. 1 and 2, the insulation body 300 includes a first fixing body 321, a second fixing body 322, a connection portion positioning body 330, a first arm positioning body 311, and a second arm positioning body 312. The first fixation portion 150 of the first contact 100 is fixed to the first fixing body 321. The second fixation portion 250 of the second contact 200 is fixed to the second fixing body 322. In an embodiment, the first fixing body 321 is separately molded on the first contact 100, and similarly, the second fixing body 322 is separately molded on the second contact 200.

In an embodiment, the first fixing body 321, the second fixing body 322, the connection portion positioning body 330, the first arm positioning body 311 and the second arm positioning body 312 may be assembled together to form the complete insulation body 300. In another embodiment, the insulation body 300 may be a single molded piece that is formed on the row of the first contacts 100 and the row of the second contacts 200 by a molding process.

As shown in FIGS. 1 and 2, the first connection portion 130 of each of the first contacts 100 is positioned on an outer side of the connection portion positioning body 330, and the second connection portion 230 of each of the second contacts 200 is positioned on an inner side of the connection portion positioning body 330. The first elastic arm 140 of each of the first contacts 100 is positioned on the first arm positioning body 311. The second elastic arm 240 of each of the second contacts 200 is positioned on the second arm positioning body 312.

In the embodiment shown in FIGS. 1 and 2, a row of first positioning protrusions 331 are formed at a bottom of an outer side of the connection portion positioning body 330, and each of the first connection portions 130 is positioned between two adjacent first positioning protrusions 331. A row of second positioning protrusions are formed at a bottom of an inner side of the connection portion positioning body 330, and each of the second connection portions 230 is positioned between two adjacent second positioning protrusions. Each of the first positioning protrusions 331 is located at a root portion of the corresponding first connection portion 130 that is connected to the corresponding first solder foot 110; similarly, each of the second positioning protrusions is located at a root portion of the corresponding second connection portion 230 that is connected to the corresponding second solder foot 210.

What is claimed is:

1. A connector, comprising:

an insulation body; and a row of first contacts arranged on the insulation body at a first pitch, each of the first contacts includes a first solder foot, a first fixation portion, and a first connection portion between the first solder foot and the first fixation portion, no insulation partition rib is disposed between the first connection portions of any two adjacent first contacts;

a row of second contacts disposed below the row of first contacts and arranged on the insulation body at a second pitch; each of the second contacts includes a second solder foot, a second fixation portion, and a second connection portion between the second solder foot and the second fixation portion;

the insulation body including:

a first fixing body on which each of the first fixation portions is fixed;

a second fixing body on which each of the second fixation portions is fixed;

a connection portion positioning body, each of the first connection portions being positioned on an outer side of the connection portion positioning body and each of the second connection portions being positioned on an inner side of the connection portion positioning body.

2. The connector of claim 1, wherein a first air gap is disposed between the insulation body and the first connection portion of each of the first contacts.

3. The connector of claim 1, wherein no insulation partition rib is disposed between the second connection portions of any two adjacent second contacts.

4. The connector of claim 3, wherein a second air gap is disposed between the insulation body and the second connection portion of each of the second contacts.

5. The connector of claim 4, wherein the first air gap is equal to the second air gap.

6. The connector of claim 5, wherein the first air gap is about 0.035 mm.

7. The connector of claim 4, wherein each of the first contacts includes a first contact portion and a first elastic arm between the first contact portion and the first fixation portion.

8. The connector of claim 7, wherein each of the second contacts includes a second contact portion and a second elastic arm between the second contact portion and the second fixation portion.

9. The connector of claim 8, wherein the insulation body includes:

a first arm positioning body on which each of the first elastic arms is positioned; and a second arm positioning body on which each of the second elastic arms is positioned.

10. The connector of claim 9, wherein the first fixing body, the second fixing body, the connection portion positioning body, the first arm positioning body, and the second arm positioning body are assembled together to form the insulation body.

11. The connector of claim 8, wherein the insulation body is a single molded piece that is formed on the row of first contacts and the row of second contacts.

12. The connector of claim 1, wherein a row of first positioning protrusions are formed at a bottom of the outer side of the connection portion positioning body, and each of the first connection portions is positioned between two adjacent first positioning protrusions.

13. The connector of claim 12, wherein a row of second positioning protrusions are formed at a bottom of the inner side of the connection portion positioning body, and each of the second connection portions is positioned between two adjacent second positioning protrusions.

14. The connector of claim 13, wherein each of the first positioning protrusions is located at a root portion of the first connection portion that is connected to the first solder foot.

15. The connector of claim 14, wherein each of the second positioning protrusions is located at a root portion of the second connection portion that is connected to the second solder foot.

16. The connector of claim 1, wherein the first pitch is equal to the second pitch.

* * * * *